US005723839A

United States Patent [19]

Kozawa

[11] Patent Number: 5,723,839

[45] Date of Patent: Mar. 3, 1998

[54] GAS CIRCUIT BREAKER

[75] Inventor: Hiroshi Kozawa, Hitachinaka, Japan

[73] Assignee: Hitachi, Ltd., Tokyo, Japan

[21] Appl. No.: 681,361

[22] Filed: Jul. 23, 1996

[30] Foreign Application Priority Data

Aug. 8, 1995 [JP] Japan ..... 7-201911

[51] Int. Cl.[6] ..... H01H 33/70

[52] U.S. Cl. ..... 218/43; 218/68

[58] Field of Search ..... 218/43, 46, 48–50, 218/56, 57, 59–61, 65, 84, 68–71, 74–78, 152–155

[56] References Cited

U.S. PATENT DOCUMENTS

| | | | |
|---|---|---|---|
| 3,745,284 | 7/1973 | Hosokawa | 200/148 A |
| 4,236,053 | 11/1980 | Sasaki et al. | 200/144 R |
| 4,516,006 | 5/1985 | Kobayashi et al. | 200/148 A |
| 4,749,831 | 6/1988 | Hosomi et al. | 200/148 A |
| 5,243,160 | 9/1993 | Ohno et al. | 200/148 F |

FOREIGN PATENT DOCUMENTS

| | | | |
|---|---|---|---|
| 62-61220 | 3/1987 | Japan | H01H 33/64 |
| 2-44621 | 2/1990 | Japan | H01H 33/24 |

*Primary Examiner*—Michael L. Gellner
*Assistant Examiner*—Michael A. Friedhofer
*Attorney, Agent, or Firm*—Fay, Sharpe, Beall, Fagan, Minnich & McKee

[57] ABSTRACT

A gas circuit breaker having a single supporting structure easy to be inspected. The gas circuit breaker includes: a grounded tank in which a gas is enclosed; a fixed contact contained in the tank; a moving contact contained in the tank and electrically connected to the fixed contact; an insulating grounded support for supporting the moving contact in a state that the moving contact is insulated from the tank; an inter-contact insulating tube for supporting the fixed contact in such a manner that the fixed contact is insulated from the moving contact; an in-bushing conductor connected to the side of the fixed contact; an in-bushing conductor connected to the side of the moving contact; and a maintenance cover removably provided on a side end portion of the tank. The gas circuit breaker further includes a fixed contact side conductor mounted on the fixed contact; and a connecting conductor, mounted on the fixed contact side conductor, for slidably supporting the in-bushing conductor, wherein a hole which allows the connecting conductor to be moved in the axial direction of the in-bushing conductor is formed in the fixed contact side conductor.

3 Claims, 6 Drawing Sheets

GAS CIRCUIT BREAKER

BACKGROUND OF THE INVENTION

The present invention relates to a gas circuit breaker, and particularly to a gas circuit breaker of a single supporting structure in which live parts provided in a grounded tank are supported by one insulating grounded support.

Gas circuit breakers of a twin supporting structure have been known from Japanese Patent Laid-open Nos. Sho 62-61220 and Hei 2-44621. In the twin supporting structure, a live part containing a moving contact and a live part containing a fixed contact are independently supported by different insulating grounded supports. The moving contact is connected to an in-bushing conductor through a conductor, and the fixed contact is connected to an in-bushing conductor through a conductor. In a circuit breaker for interrupting a large current during operation, contacts must be periodically inspected and replaced. For this reason, a maintenance cover is required to be provided to a tank. In a gas circuit breaker of a twin supporting structure, such a maintenance cover is generally provided on a side surface, of a cylindrical tank, near a fixed contact and a moving contact.

In such a gas circuit breaker of a twin supporting structure, however, alignment and assembling adjustment such as stroke positional adjustment are required for the moving contact and the fixed contact. Thus, in recent years, a gas circuit breaker of a single supporting structure has been adopted.

In a gas circuit breaker of a single supporting structure, a live part including a fixed contact is supported by an insulating grounded support and a live part including a moving contact is supported by the same insulating grounded support through an inter-contact insulating tube.

In this gas circuit breaker of the single supporting structure, however, the fixed contact and the moving contact are covered with the inter-contact insulating tube and an inter-contact interrupter is contained in the inter-contact insulating tube, and thereby a maintenance cover can not be provided on a side surface of a cylindrical tank but is provided on one end portion of the cylindrical tank. The gas circuit breaker of a single supporting structure has a disadvantage that a bushing must be removed for the inspection or replacement of contacts from the maintenance cover, resulting in taking much time. This is because a fixed contact portion cannot be removed unless the bushing is removed and then an in-bushing conductor mounted to the bushing is removed. It takes a lot of labor to remove the bushing being very large in weight.

Contacts of a gas circuit breaker must be replaced after the interruption of an interrupting current being about 70% of the maximum interrupting current is repeated by about ten times. It takes much time to remove the bushing for each replacement of the contacts.

Also, for the removal of the bushing for periodical inspection, it takes a lot of time and labor. Once the bushing is removed, it is necessary to inspect the bushing portion after re-assembly thereof

SUMMARY OF THE INVENTION

An object of the present invention is to provide a gas circuit breaker of a single supporting structure, which can be easily inspected.

To achieve the above object, according to a preferred mode of the present invention, there is provided a gas circuit breaker including: a grounded tank in which a gas is enclosed; a fixed contact contained in the tank; a moving contact contained in the tank and electrically connected to the fixed contact; an insulating grounded support for supporting the moving contact in a state that the moving contact is insulated from the tank; an inter-contact insulating tube for supporting the fixed contact in such a manner that the fixed contact is insulated from the moving contact; an in-bushing conductor connected to the side of the fixed contact; an in-bushing conductor connected to the side of the moving contact; and a maintenance cover removably provided on a side end portion of the tank; the improvement including: a fixed contact side conductor mounted on the fixed contact; and a connecting conductor, mounted on the fixed contact side conductor, for slidably supporting the in-bushing conductor; wherein the fixed contact side conductor has a hole which allows the connecting conductor to be moved in the axial direction of the in-bushing conductor. With this configuration, the connecting conductor can be removed from the in-bushing conductor through the hole, and thereby contacts can be inspected without removal of a bushing.

In the above gas circuit-breaker, preferably, the connecting conductor includes a connecting portion with a conical end contacted with the in-bushing conductor, and an elliptic mounting portion perpendicular to the connecting portion; the hole formed in the fixed contact side conductor has an elliptic shape allowing the mounting portion to pass therethrough; and the connecting conductor electrically connects the in-bushing conductor to the side of the fixed contact and slidably supports the in-bushing conductor by rotating the connecting conductor from a state in which the elliptic hole formed in the fixed contact side conductor corresponds to the elliptic mounting portion of the connecting conductor. With this configuration, the removal of the connecting conductor can be easily performed.

In the above gas circuit breaker, preferably, the connecting conductor includes a first connecting conductor electrically connected to the in-bushing conductor, and a second connecting conductor mounted between the first connecting conductor and the fixed contact side conductor; the hole formed in the fixed contact side conductor allows the first connecting conductor to pass therethrough; and the first connecting conductor is removed through the hole formed in the fixed contact side conductor by removing the second connecting conductor from the first connecting conductor and the fixed contact side conductor. With this configuration, the connecting conductor can be easily performed even for a gas circuit breaker of a large current capacity.

DETAILED DESCRIPTION OF THE PREFERRED EMBODIMENTS

Hereinafter, a first embodiment of the present invention will be described with reference to FIGS. 1 to 4.

Figure 1:
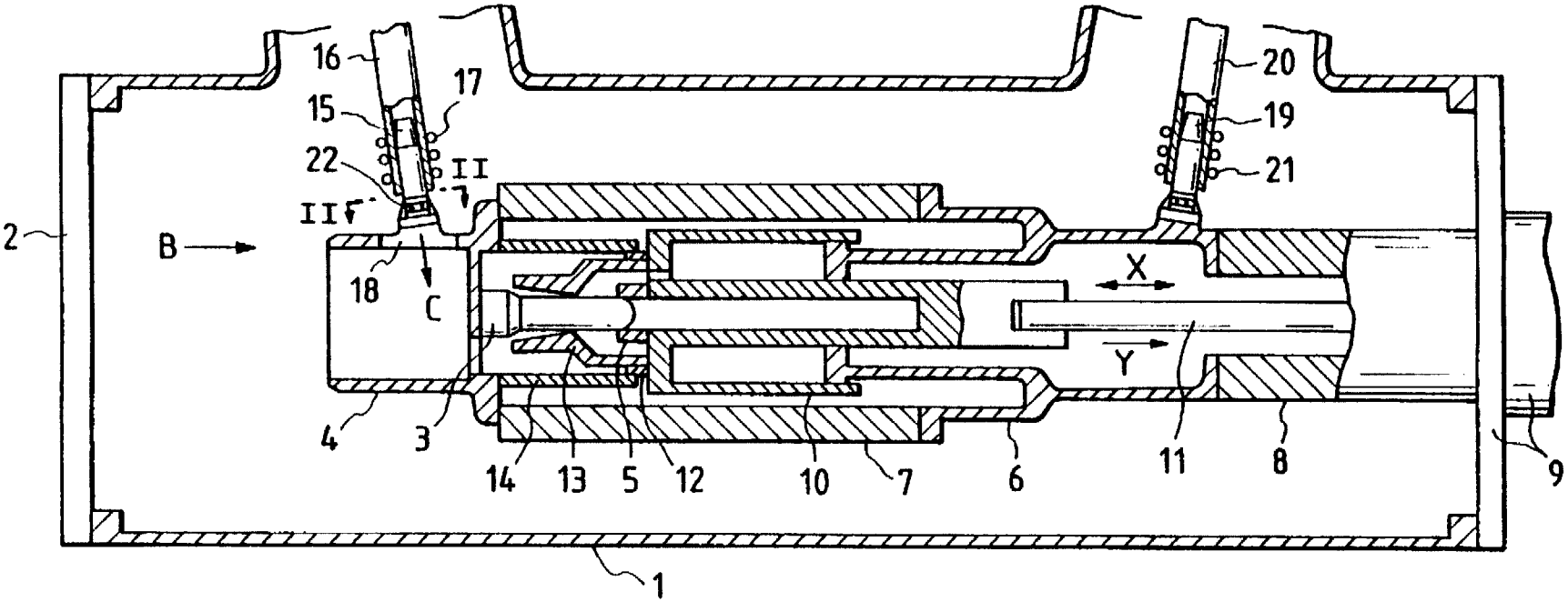
FIG. 1 is a partial sectional view showing an internal structure of an essential portion of a first embodiment of a gas circuit breaker of the present invention.

FIG. 1 is a partial sectional view showing an inside construction of an essential portion of the first embodiment of a gas circuit breaker of the present invention.

A grounded tank 1 is enclosed with SF6 gas therein, and is provided with a live interrupter. The tank 1 is formed in a cylindrical shape. A maintenance cover 2 is mounted at one end of the tank 1, and a link case 9 is mounted at the other end of the tank 1. The upper surface of the tank 1, while not shown, extends and is mounted with a bushing.

An insulating grounded support 8 is fixed on the link case 9, and a moving contact side conductor 6 is fixed on the insulating grounded support 8. A buffer cylinder 10 is slidably engaged with the moving contact side conductor 6. An insulating rod 11 is mounted on the buffer cylinder 10 in such a manner as to be slidably operated from the outside of the tank 1 in the direction of an arrow X through a link mechanism (not shown) contained in the link case 9. A moving arc contact 5 and a moving main contact 12 are mounted on an end portion of the buffer cylinder 10. A nozzle 13 is also mounted on the end portion of the buffer cylinder 10.

A cylindrical inter-contact insulating tube 7 has one end fixed on the moving contact side conductor 6. The inter-contact insulating tube 7 is disposed so as to cover a moving contact and a fixed contact. A fixed contact side conductor 4 is mounted on the other end of the inter-contact insulating tube 7. A fixed arc contact 3 is mounted at the center of the fixed contact side conductor 4, and a fixed main contact 14 is mounted on the outer peripheral side of the fixed arc contact 3.

A connecting conductor 15 is mounted on a side surface of the fixed contact side conductor 4. The connecting conductor 15 is inserted in an opening end of a cylindrical in-bushing conductor 16. The opening end of the in-bushing conductor 16 is cut into a cylindrical shape in cross-section. The in-bushing conductor 16 is electrically connected to and is slidable on the connecting conductor 15 by fastening the in-bushing conductor 16 toward its center by means of a spring mounted around the outer periphery of the opening end of the in-bushing conductor 16. A hole 18 is formed in a side surface of the fixed contact side conductor 4. The detail of the hole 18 will be described later with reference to FIGS. 2 and 3. The other end of the in-bushing conductor 16 is connected to a bushing (not shown).

A connecting conductor 19 is mounted on a side surface of the moving contact side conductor 6. The connecting conductor 19 is inserted in an opening end of a cylindrical in-bushing conductor 20. The opening end of the in-bushing conductor 20 is cut into a cylindrical shape in cross-section. The in-bushing conductor 20 is electrically connected to and slidable on the connecting conductor 19 by fastening the in-bushing conductor 20 toward its center by means of a spring 21 mounted around the outer periphery of the opening end of the in-bushing conductor 20.

The moving contact composed of the moving main contact 12 and the moving arc contact 5 is thus supported by the insulating grounded support 8 through the buffer cylinder 10 and the moving contact side conductor 6. On the other hand, the fixed contact composed of the fixed main contact 14 and the fixed arc contact 3 is supported by the insulating grounded support 8 through the inter-contact insulating tube 7 and the moving contact side conductor 6. Each of the moving contact and the fixed contact is supported in a single support manner by means of the same insulating grounded support 8.

In the state shown in FIG. 1, the fixed main contact 14 is contacted with the moving main contact 12 while the fixed arc contact 3 is contacted with the moving arc contact 5. Accordingly, the moving contact is electrically connected to the fixed contact. The fixed main contact 14 has at the leading end a slit (not shown), and is strongly fastened to the moving main contact 12 in the center direction by a fastening force of a spring from the outer peripheral side. The moving arc contact 5 has at the leading end a slit (not shown), and is fastened to the fixed arc contact 3 in the center direction by a fastening force of a spring from the outer peripheral side.

When the insulating rod 11 is moved in the direction of an arrow Y, the buffer cylinder 10 is slid in the same direction. At this time, the moving main contact 12 is first removed from the fixed main contact 14, and subsequently the moving arc contact 5 is removed from the fixed arc contact 3. An arc generated upon removal of the moving arc contact 5 from the fixed arc contact 3 is extinguished by the $SF_6$ gas jetted from the nozzle 13 in the buffer cylinder 10, and the current is interrupted.

The detail structure of the connecting conductor portion of the first embodiment of the gas circuit breaker of the present invention will be described with reference to FIGS. 2 and 3.

Figure 2:
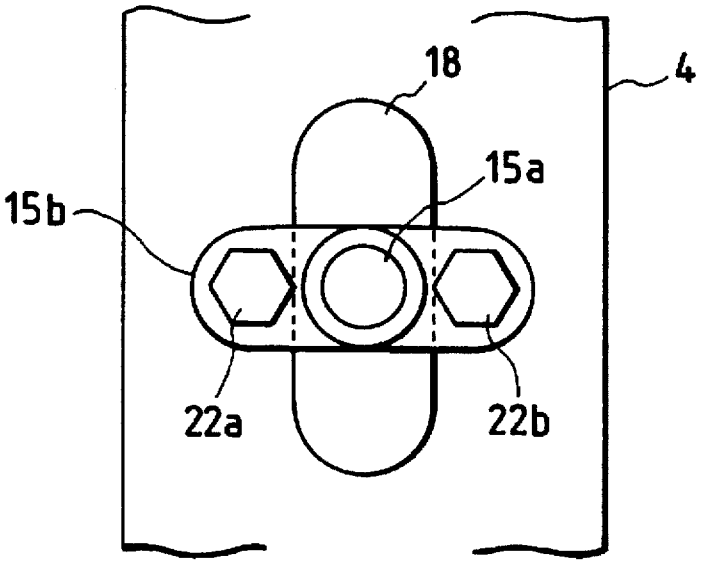
FIG. 2 is a view seen from the line A—A of FIG. 1.
Figure 3:
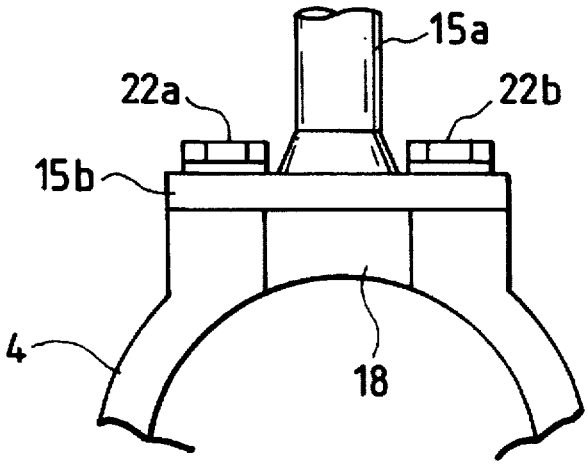
FIG. 3 is a side view in the direction of B of FIG. 1.

FIG. 2 is a view seen from the line II—II in FIG. 1, and FIG. 3 is a side view seen in the direction of B in FIG. 1.

The hole 18 formed in the fixed contact side conductor 4 has an elliptic shape shown in FIG. 2. The longitudinal direction of the hole 18 corresponds to the axial direction of the fixed contact. On the other hand, the connecting conductor 15 is formed in a T-shape, and it is composed of a connecting portion 15*a* with a conical end to be contacted with the in-bushing conductor 16, and an elliptic mounting portion 15*b* perpendicular to the connecting portion 15*a*.

The longitudinal direction of the mounting portion 15*b* of the connecting conductor 15 is perpendicular to the longitudinal direction of the hole 18, as shown in FIG. 2, and the mounting portion 15*b* of the connecting conductor 15 is fixed on the fixed contact side conductor 4 by means of bolts 22*a*, 22*b*, as shown in FIG. 3.

In addition, the major axis and minor axis of the mounting portion 15*b* of the connecting conductor 15 are set to be smaller than the major axis and minor axis of the hole 18, respectively. The mounting portion 15*b* of the connecting conductor 15 in the state shown in FIG. 2 can be thus depressed in the hole 18 by removing the bolts 22*a*, 22*b* and rotating the mounting portion 15*b* of the connecting conductor 15 in the direction of an arrow Z by 90°. As a result, the connecting conductor 15 can be drawn in the direction of an arrow C in FIG. 1.

The method of inspecting the first embodiment of the gas circuit breaker of the present invention will be described with reference to FIG. 4.

Figure 4:
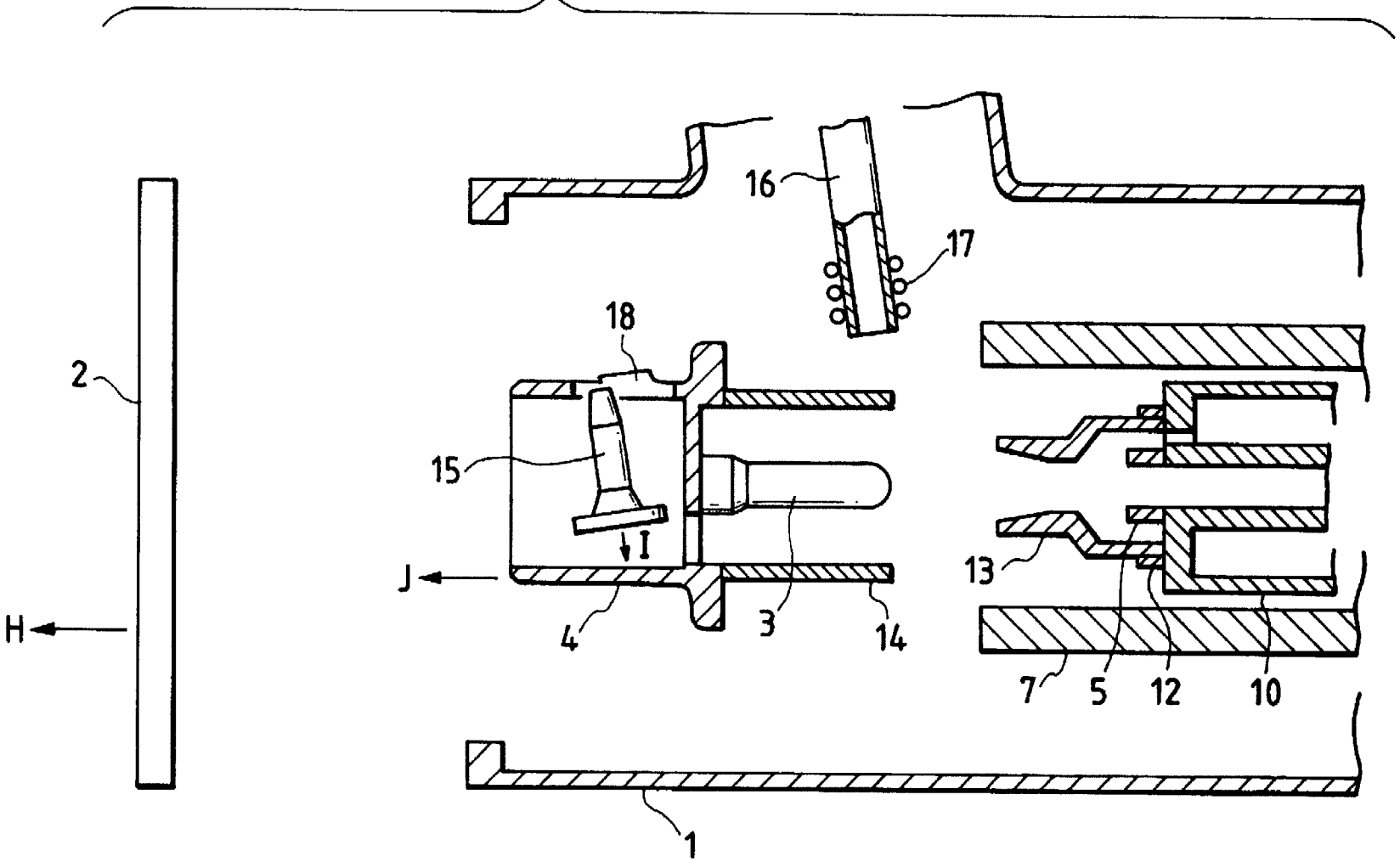
FIG. 4 is partial sectional view showing a disassembled and inspected state of an essential portion of the first embodiment of the gas circuit breaker of the present invention.

FIG. 4 is a partial sectional view of a disassembled and inspected state of an essential portion of the first embodiment of the gas circuit breaker of the present invention.

Referring to FIG. 4, upon inspection or replacement of contacts, the maintenance cover 2 is first removed in the direction of an arrow H. The bolts 22a, 22b, which fasten the connecting conductor 15 to the fixed contact side conductor 4, is then removed by an operator's hand inserted in the tank 1. After removal of the bolts 22a, 22b, the connecting conductor 15 is depressed in the hole 18 by holding the mounting portion 15b of the connecting conductor 15, rotating it by 90° and drawing the connecting conductor 15 in the direction of an arrow I. Although the in-bushing conductor 16 fastens the connecting conductor 15 by the tension of the spring 17, the tension is only in a range capable of preventing the connecting conductor 15 from being dropped by its dead weight. Accordingly, the connecting conductor 15 can be easily drawn from the in-bushing conductor 16 by manual operation of the operator. For a gas circuit breaker having a current capacity of 2000 A at 72 kV, the size of the connecting conductor 15 is as follows: the diameter of the connecting portion 15a is 20 mm and the length thereof is 100 mm, and the weight of the connecting conductor 15 is about 200 g. Consequently, the connecting conductor 15 is easy to be handled. Moreover, since the diameter of the cylindrical fixed contact side conductor 4 is 150 mm, the connecting conductor 15 can be perfectly drawn from the in-bushing conductor 16 and contained in a space in the fixed contact side conductor 4.

Then, by movement of the fixed contact side conductor 4 in the direction of an arrow J, the fixed main contact 14 and the fixed arc contact 3 can be removed together with the fixed contact side conductor 4. The fixed arc contact 3, which is a replacement part upon inspection, can be replaced by removal of the fixed arc contact 3 from the fixed contact side conductor 4.

The uppermost end of the fixed contact side conductor 4, which is a position to be contacted with the upper end of the inter-contact insulating tube 7, is lower than the lowermost position of the in-bushing conductor 16, and accordingly, the fixed contact side conductor 4 can be moved in the direction of the arrow J without obstruction of the in-bushing conductor 16.

The moving arc contact 5 and the nozzle 13 can be replaced by removal of the fixed contact side conductor 4, the fixed main contact 14 and the fixed arc contact 3.

Thus, the fixed contact side conductor 4 can be easily removed by drawing the connecting conductor 15 from the in-bushing conductor 16 without removal of the in-bushing conductor 16 itself, and thereby the fixed arc contact 3, the moving arc contact 5 and the nozzle 13 can be replaced. This enables inspection and replacement for a short period of time as compared with the case of removal of the in-bushing conductor 16 itself from the bushing.

Hereinafter, a second embodiment of the present invention will be described with reference to FIGS. 5 to 8.

Figure 5:
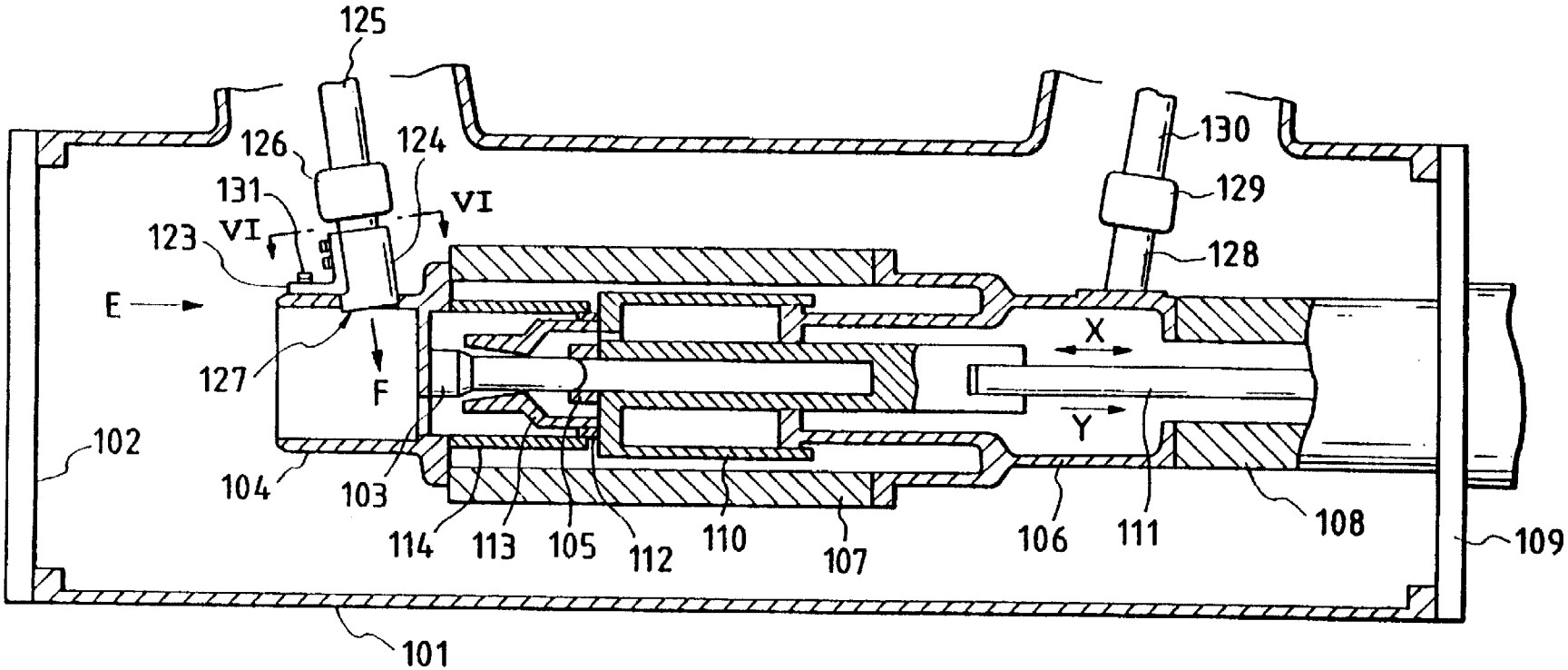
FIG. 5 is a partial sectional view showing an internal structure of an essential portion of a second embodiment of the gas circuit breaker of the present invention.

FIG. 5 is a partial sectional view showing an inside structure of an essential portion of the second embodiment of the gas circuit breaker of the present invention. This embodiment is suitable for a gas circuit breaker having a current capacity larger than that shown in FIG. 1, for example, 2000 A or more.

A grounded tank 101 is enclosed with SF6 gas therein, and is provided with a live interrupter. The tank 101 is formed in a cylindrical shape. A maintenance cover 102 is mounted at one end of the tank 101, and a link case 109 is mounted at the other end of the tank 101. The upper surface of the tank 101, while not shown, extends and is mounted with a bushing.

An insulating grounded support 108 is fixed on the link case 109, and a moving contact side conductor 106 is fixed on the insulating grounded support 108. A buffer cylinder 110 is slidably engaged with the moving contact side conductor 106. An insulating rod 111 is mounted on the buffer cylinder 110 in such a manner as to be slidably operated from the outside of the tank 101 in the direction of an arrow X through a link mechanism (not shown) contained in the link case 109. A moving arc contact 105 and a moving main contact 112 are mounted on an end portion of the buffer cylinder 110. A nozzle 113 is also mounted on the end portion of the buffer cylinder 110.

A cylindrical inter-contact insulating tube 107 has one end fixed on the moving contact side conductor 106. The inter-contact insulating tube 107 is disposed so as to cover a moving contact and a fixed contact. A fixed contact side conductor 104 made of aluminum is mounted on the other end of the inter-contact insulating tube 107. A fixed arc contact 103 is mounted at the center of the fixed contact side conductor 104, and a fixed main contact 114 made of copper is mounted on the outer peripheral side of the fixed arc contact 103.

A connecting conductor 124 made of copper is mounted on a side surface of the fixed contact side conductor 104 by means of a V-shaped connecting conductor 123 made of copper. The connecting conductor 124 is inserted in a tulip contact 126 mounted on an end portion of a cylindrical in-bushing conductor 125. The tulip contact 126 is covered with an insulator, and thereby does not disturb the electric field of the neighborhoods thereof even when it is applied with a large current. The tulip contact 126 has a spring therein, and fastens the in-bushing conductor 125 and the connecting conductor 124 in the center direction and thereby the in-bushing conductor 125 is electrically connected to and slidable on the connecting conductor 124. The fixed contact side conductor 104A has a hole 127 formed in a side surface thereof. The hole 127, and the connecting conductors 123, 124 will in detail be described with reference to FIGS. 6, 7. The in-bushing conductor 125 has the other end connected to a bushing (not shown).

In the second embodiment, the shape of the connecting conductor is different from that of the first embodiment shown in FIG. 1. The reason for this is as follows. In the structure shown in FIG. 1, the contact surface between the connecting conductor 15 and the fixed contact side conductor 4 is limited to the mounting portion 15b of the connecting conductor 15 because the hole 18 is positioned opposite to the connecting portion 15a as the connecting terminal (see FIG. 2). Accordingly, the area of the contact surface is not made larger so much, that is, the resistance of the contact surface is not reduced, as a result of which the structure shown in FIG. 1 is not suitable for a large current application. On the contrary, the connecting conductor 123 is V-shaped, and thereby the area of the contact surface of the fixed contact side conductor 104 is made larger as compared with the connecting conductor shown in FIG. 1 by increasing the width and length of the connecting conductor 123. As a result, the structure shown in FIG. 5 is suitable for a large current application.

A connecting conductor 128 is mounted on a side surface of the moving contact side conductor 106. The connecting conductor 128 is connected to the in-bushing conductor 130 through a cylindrical tulip contact 129, so that the in-bushing conductor 130 is electrically connected to and slidable on connecting conductor 128.

Accordingly, the moving contact composed of the moving main contact 112 and the moving arc contact 105 is supported by the insulating grounded support 108 through the buffer cylinder 110 and the moving contact side conductor 106. On the other hand, the fixed contact composed of the fixed main contact 114 and the fixed arc contact 103 is supported by the insulating grounded support 108 through the inter-contact insulating tube 107 and the moving contact side conductor 106. Each of the moving contact and the fixed contact is supported in a single support manner by the same insulating grounded support 108.

In the state shown in FIG. 5, the fixed main contact 114 is contacted with the moving main contact 112 while the fixed arc contact 103 is contacted with the moving arc contact 105. Accordingly, the moving contact is electrically connected to the fixed contact. The fixed main contact 114 has at the leading end a slit (not shown), and is strongly fastened to the moving main contact 112 in the center direction by a fastening force of a spring from the outer peripheral side. The moving arc contact 105 has at the leading end a slit (not shown), and is fastened to the fixed arc contact 103 in the center direction by a fastening force of a spring from the outer peripheral side.

When the insulating rod 111 is moved in the direction of an arrow Y, the buffer cylinder 110 is slid in the same direction. At this time, the moving main contact 112 is first removed from the fixed main contact 114, and subsequently the moving arc contact 105 is removed from the fixed arc contact 103. An arc generated upon removal of the moving arc contact 105 from the fixed arc contact 103 is extinguished by the SF6 gas jetted from the nozzle 113 in the buffer cylinder 110, and the current is interrupted.

The detail structure of the connecting conductor portion of the second embodiment of the gas circuit breaker of the present invention will be described with reference to FIGS. 6 and 7.

Figure 6:
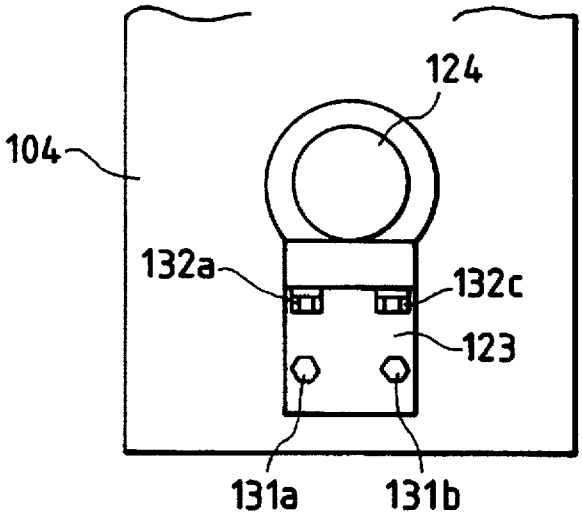
FIG. 6 is a view seen from the line D—D of FIG. 5.
Figure 7:
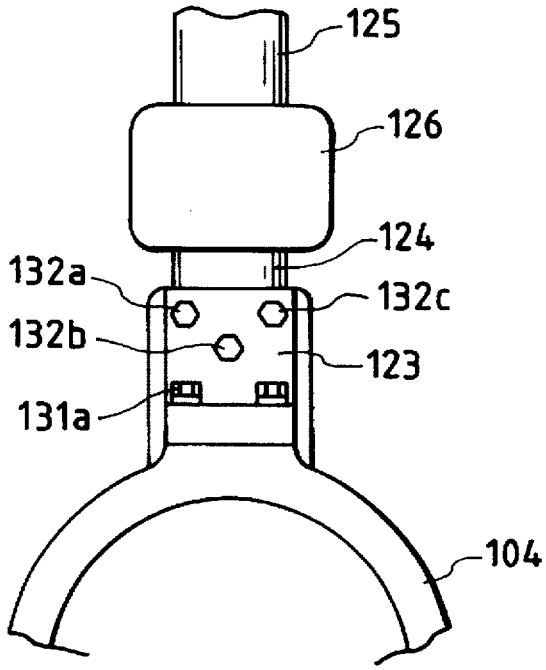
FIG. 7 is a side view seen in the direction of E of FIG. 5.

FIG. 6 is a view seen from the line VI—VI in FIG. 5, and FIG. 7 is a side view seen in the direction of E in FIG. 5.

The hole 127 formed in the fixed contact side conductor 104 has a circular shape, and the diameter of the hole 127 is slightly larger than that of the connecting conductor 124. The connecting conductor 123 is V-shaped, and is fixed on the fixed contact side conductor 104 by means of bolts 131*a*, 131*b*. The connecting conductor 123 is also fixed on the connecting conductor 124 by means of bolts 132*a*, 132*b*, 132*c*.

The connecting conductor 124 in the state shown in FIG. 5 can be depressed in the hole 127 by removing the bolts 131*a*, 131*b* and then removing the bolts 132*a*, 132*b*, 132*c*. As a result, the connecting conductor 124 can be drawn out in the direction of an arrow F in FIG. 5.

The inspecting method for the second embodiment of the gas circuit breaker of the present invention will be described with reference to FIG. 8.

Figure 8:
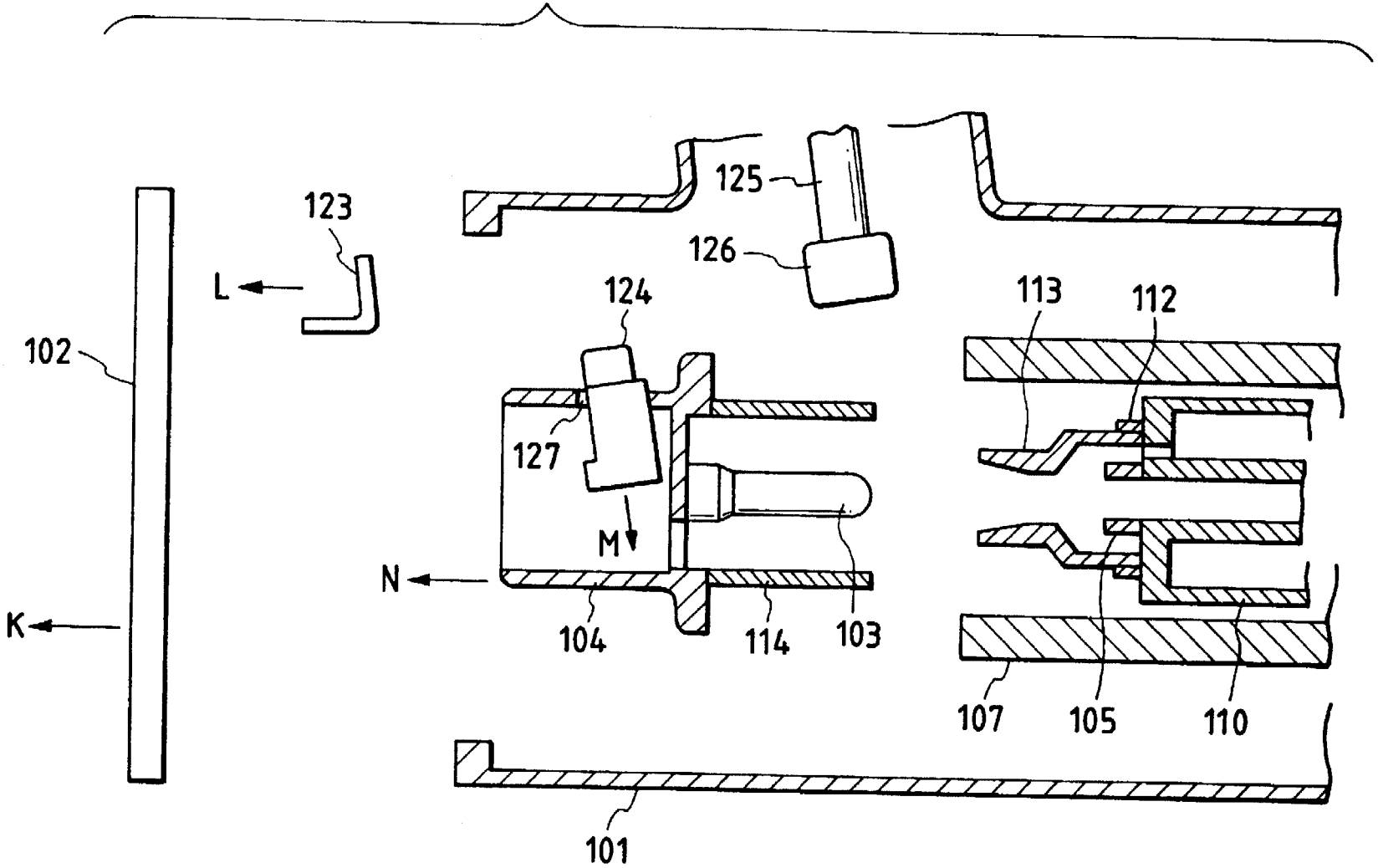
FIG. 8 is a partial sectional view showing a disassembled and inspected state of an essential portion of the second embodiment of the gas circuit breaker of the present invention.

FIG. 8 is a partial sectional view of a disassembled and inspected state of an essential portion of the second embodiment of the gas circuit breaker of the present invention.

Referring to FIG. 8, upon inspection or replacement of contacts, the maintenance cover 102 is first removed in the direction of an arrow K. The bolts 131*a*, 131*b*, which fasten the connecting conductor 123 to the fixed contact side conductor 104, are then removed by an operator's hand inserted in the tank 101. After that, the bolts 132*a*, 132*b*, 132*c* are also removed, and then the connecting conductor 124 is depressed in the hole 127 by drawing the connecting conductor 124 in the direction of an arrow M. For a gas circuit breaker having a current capacity of 6000 A at 168 kV, the size of the connecting conductor 124 is as follows: the diameter is 60 mm and the length is 200 mm, and the weight of the connecting conductor 124 is about several hundreds g. Consequently, the connecting conductor 124 is easy to be handled. Moreover, since the diameter of the cylindrical fixed contact side conductor 104 is 250 mm, the connecting conductor 124 can be perfectly drawn out from the tulip contact 126 and contained in a space in the fixed contact side conductor 104.

Then, by movement of the fixed contact side conductor 104 in the direction of an arrow N, the fixed main contact 114 and the fixed arc contact 103 can be removed together with the fixed contact side conductor 104. The fixed arc contact 103, which is a replacement part upon inspection, can be replaced by removal of the fixed arc contact 103 from the fixed contact side conductor 104.

The uppermost end of the fixed contact side conductor 104, which is a position to be contacted with the upper end of the inter-contact insulating tube 107, is lower than the lowermost position of the in-bushing conductor 125, and accordingly, the fixed contact side conductor 104 can be moved in the direction of the arrow N without obstruction of the in-bushing conductor 125.

The moving arc contact 105 and the nozzle 113 can be replaced by removal of the fixed contact side conductor 104, the fixed main contact 114 and the fixed arc contact 103.

Thus, the fixed contact side conductor 104 can be easily removed by drawing the connecting conductor 124 from the in-bushing conductor 125 without removal of the in-bushing conductor 125 itself, and thereby the fixed arc contact 103, the moving arc contact 105 and the nozzle 113 can be replaced. This enables inspection and replacement for a short period of time as compared with the case of removal of the in-bushing conductor 125 itself from the bushing.

According to the present invention, it is possible to make easy the inspection of a gas circuit breaker of a single supporting structure.

What is claimed is:

1. In a gas circuit breaker comprising:

a grounded tank in which a gas is enclosed;

a fixed contact contained in said tank;

a moving contact contained in said tank and electrically connected to said fixed contact;

an insulting grounded support for supporting said moving contact in a state that said moving contact is insulated from said tank;

an inter-contact insulating tube for supporting said fixed contact in such a manner that said fixed contact is insulated from said moving contact;

an in-bushing conductor connected to a side of said fixed contact;

an in-bushing conductor connected to a side of said moving contact; and a maintenance cover removably provided on a side end portion of said tank;

the improvement comprising:

a fixed contact side conductor mounted on said fixed contact; and a connecting conductor, mounted on said fixed contact side conductor, for slidably supporting said in-bushing conductor;

wherein said fixed contact side conductor has a hole which allows said connecting conductor to be moved in an axial direction of said in-bushing conductor.

2. A gas circuit breaker according to claim 1, wherein said connecting conductor includes a connecting portion with a conical end contacted with said in-bushing conductor, and an elliptic mounting portion perpendicular to said connecting portion;

said hole formed in said fixed contact side conductor has an elliptic shape allowing said mounting portion to pass therethrough; and said connecting conductor electrically connects said in-bushing conductor to the side of said fixed contact and slidably supports said in-bushing conductor by rotating said connecting conductor from a state in which said elliptic hole formed in said fixed contact side conductor corresponds to said elliptic mounting portion of said connecting conductor.

3. A gas circuit breaker according to claim 1, wherein said connecting conductor includes a first connecting conductor electrically connected to said in-bushing conductor, and a second connecting conductor mounted between said first connecting conductor and said fixed contact side conductor;

said hole formed in said fixed contact side conductor allows said first connecting conductor to pass therethrough; and said first connecting conductor is removed through said hole formed in said fixed contact side conductor by removing said second connecting conductor from said first connecting conductor and said fixed contact side conductor.

* * * * *